US007102113B2

(12) United States Patent
Fujita et al.

(10) Patent No.: US 7,102,113 B2
(45) Date of Patent: Sep. 5, 2006

(54) THREE-AXIS ATTITUDE CONTROL PROPULSION DEVICE AND FLYING OBJECT COMPRISING THE SAME

(75) Inventors: Toshiharu Fujita, Komaki (JP); Shozo Hidaka, Komaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 197 days.

(21) Appl. No.: 10/781,701

(22) Filed: Feb. 20, 2004

(65) Prior Publication Data

US 2004/0245371 A1 Dec. 9, 2004

(30) Foreign Application Priority Data

Apr. 7, 2003 (JP) ..... 2003-102445

(51) Int. Cl.
*F41G 7/00* (2006.01)
*G05D 1/00* (2006.01)

(52) U.S. Cl. ..... 244/3.1; 244/3.21

(58) Field of Classification Search ..... 244/3.1, 244/3.2–3.22; 89/1.51–1.6, 1.8, 1.804, 1.806; 102/384, 388; 701/3, 4; 703/1, 9, 10, 11, 703/12

See application file for complete search history.

(56) References Cited

U.S. PATENT DOCUMENTS 3,305,194 A * 2/1967 Conard et al. ..... 244/3.21
3,678,960 A * 7/1972 Leibinsohn ..... 137/625.47
3,774,634 A * 11/1973 Bonney ..... 137/596
3,927,693 A * 12/1975 Johnston ..... 137/625.47
4,011,720 A * 3/1977 Kirschner, Jr. ..... 60/254
4,384,690 A * 5/1983 Brodersen ..... 244/3.22
4,413,795 A * 11/1983 Ryan ..... 244/3.22
4,463,921 A * 8/1984 Metz ..... 244/3.22
4,482,107 A * 11/1984 Metz ..... 244/3.22
4,541,592 A * 9/1985 Moll ..... 244/3.22
4,712,747 A * 12/1987 Metz et al. ..... 244/3.22
4,856,734 A * 8/1989 Davies ..... 244/3.22
4,967,982 A * 11/1990 Bagley ..... 244/3.22
4,979,697 A * 12/1990 Kranz ..... 244/3.22
5,004,184 A * 4/1991 Bernard ..... 244/3.22
5,028,014 A * 7/1991 Anderson, Jr. ..... 244/3.22
6,178,741 B1 * 1/2001 Nelson et al. ..... 60/229
6,267,326 B1 * 7/2001 Smith et al. ..... 244/3.22
2005/0120703 A1 * 6/2005 Rohrbaugh et al. ..... 60/229

FOREIGN PATENT DOCUMENTS

DE 3442975 * 6/1986
JP 3291542 3/2002

* cited by examiner

*Primary Examiner*—Teri Pham Luu
*Assistant Examiner*—Stephen A. Holzen
(74) *Attorney, Agent, or Firm*—Wenderoth, Lind & Ponack, L.L.P.

(57) ABSTRACT

A three-axis attitude control propulsion device and a flying object like a rocket including the device are provided in which combustion gas for attitude control can be efficiently used. A three-axis attitude control propulsion device 4, having six nozzles has a motor case 6 and three-way discharge changeover valves 10, 10' of a valve plug rotation type enabling a changeover of a flow passage by rotation of the valve plug. Combustion gas 18 is generated by combustion of propellant 8 in the motor case 6. The three-axis attitude control propulsion device is operated so that one or two of the nozzles are opened to thereby discharge the combustion gas 18 and the remaining five or four nozzles are fully closed. Thereby, a three-axis attitude control of pitch control, roll control and yaw control, and control of a neutral state, can be selected.

16 Claims, 6 Drawing Sheets

Fig. 4

| Control | State of Jetting | Direction of Thrust |
|---|---|---|
| (a) Pitch Control | 18 12a 4 | ↓ |
| (b) Yaw Control | 18 12b 4 18 12b' | → |
| (c) Roll Control | 12b 4 18 18 12c' | ↻ |
| (d) Neutral State | 18 12a 4 18 12a' | ±0 |

| Control | State of Jetting | Direction of Thrust |
|---|---|---|
| (a) Pitch Control |   | ↓ |
| (b) Yaw Control |   | → |
| (c) Roll Control |   | ↻ |
| (d) Neutral State |   | ±0 |

THREE-AXIS ATTITUDE CONTROL PROPULSION DEVICE AND FLYING OBJECT COMPRISING THE SAME

BACKGROUND OF THE INVENTION

1. Field of the Invention

The present invention relates to a three-axis attitude control propulsion device as a part of a five-axis attitude control propulsion device used in a flying object. The device of the present invention is specifically suitable for use in a flying object such as an artificial satellite, on-trajectory work station, lunar probe, planet probe, aerospace craft, launching rocket, etc.

2. Description of the Prior Art

A flying object is known that flies or cruises while its attitude is being controlled by a propulsion device performing a five-axis attitude control. The propulsion device in this case is a prime mover that obtains a thrust as a reaction upon an action to jet outside a high pressure fluid, especially a high temperature and high pressure gas. As a typical one of the propulsion devices, a rocket engine is known.

In the flying object of the above-mentioned type, the attitude control or proceeding direction control is carried out by the propulsion device performing the five-axis control in total of a two-axis translational control and a three-axis attitude control.

The two-axis translational control will be described for reference. Where an entire part of a flying object having a certain magnitude is considered a material particle, the two-axis translational control has two axes for performing a space motion control of the flying object. Supposing that the material particle is proceeding by inertia in the direction of the X axis in a three dimensional space, a trajectory of the flying object can be changed by a thrust being added in the directions of the remaining two axes, that is, the Y axis and the Z axis. These are called the two-axes of the translational control.

Nevertheless, the actual flying object has a certain magnitude and also has a shape other than a spherical shape. Hence, even if an imaginary material particle, that is, a position of the center of gravity, is identical in a flying object, the flying object can take various different attitudes. There are three freedoms of attitude, that is, a pitch, roll and yaw. These are called three axes of the attitude control.

As prior art in this field, Japanese Patent 3,291,542 is known, wherein there are provided five pairs of nozzles, that is, ten pieces of nozzles, each pair having two nozzles directed reversely to each other, so that thrusts are generated in a maximum of ten directions to thereby perform the five-axis control, that is, the two-axis translational control and the three-axis attitude control.

In this prior art, there is provided a nozzle plug in each of the pairs of nozzles and operation of the nozzle plug can be selected such that an entire quantity of combustion gas is jetted from one of the nozzles or a half quantity of combustion gas is jetted from each of the nozzles. For this selection, a two-way discharge changeover means is used and this means is provided in each of the five pairs of nozzles.

Out of the ten nozzles, four nozzles of two pairs are used for the two-axis translational control. The remaining six nozzles of three pairs are used for the three-axis attitude control. But, as the four nozzles of the two pairs used for the two-axis translational control do not directly relate to the three-axis attitude control propulsion device of the present invention, description thereof will be omitted. Hence, description of the prior art here will proceeded on the basis of the device having six nozzles of three pairs.

In this kind of technology, however, even if no thrust is wanted to be generated in a specific direction, a mode is employed such that a half quantity of the combustion gas is jetted from each of the two nozzles of a corresponding pair to thereby cancel the thrust. Thus, the efficiency of use of the combustion gas is reduced and there arises a disadvantage that a surplus of propellant as a combustion gas source must be loaded or, if a loading quantity of the propellant is limited, an operable time of the three-axis attitude control propulsion device is reduced or an obtainable thrust is reduced. It is to be noted that the situation of jetting the combustion gas by this technology will be described later as the "Comparison Example" in comparison with embodiments according to the present invention.

Separately from the above technology, a construction having six nozzles is also known in which the six nozzles are individually opened and closed by six valves. According to this construction, while a waste of the propellant can be suppressed, the number of valves to be operated increases and the structure of the device becomes complicated to thereby easily invite a weight increase. That is, while an advantage is obtained on one side, a disadvantage is also caused on the other side.

Also, in the technology disclosed by the above-mentioned Japanese Patent 3,291,542, the nozzle plug as a flow passage selecting means is of a reciprocating type and it directly receives pressure of the high temperature high pressure combustion gas. For this reason, in the mode that the entire quantity of the combustion gas flows to one nozzle, the nozzle plug continuously receives the pressure of the combustion gas in the direction to maintain that state and a stable condition can be obtained. However, if the mode is to be changed over to another mode, that is, to a mode in which the half quantity of the combustion gas flows to the opposite nozzle or to a mode in which the entire quantity of the combustion gas flows to the opposite nozzle, there is a need to use a drive means having a large operating torque sufficient to overcome the pressure of the combustion gas. This leads to a disadvantage in that the weight of the three-axis attitude control propulsion device increases.

SUMMARY OF THE INVENTION

It is an object of the present invention to provide a three-axis attitude control propulsion device that enables attitude control with high efficiency by using combustion gas.

It is also an object of the present invention to provide a three-axis attitude control propulsion device that enables attitude control by a drive means having a small operating torque for selecting a flow passage of the combustion gas.

It is a further object of the present invention to provide a three-axis attitude control propulsion device that has a simple construction of a device, such as a device of an operating system, and also has a reduced weight.

The three-axis attitude control propulsion device of the present invention is featured in comprising two three-way discharge changeover means of a valve plug rotation type in place of three two-way discharge changeover means of a nozzle plug type.

A first conception of the present invention is a three-axis attitude control propulsion device comprising a pressure generating means and two three-way discharge changeover means connected to one end of the pressure generating means, the two three-way discharge changeover means positioned with 180 degrees between each other in a rotation symmetry around a reference of an axis of the pressure generating means.

According to the three-axis attitude control propulsion device based on the present first conception, the two discharge changeover means are provided and a construction to discharge the combustion gas in six directions is realized. Also, by operating the two discharge changeover means so as to make them cooperate with each other, the discharge of the combustion gas can be controlled. In the conventional art, three discharge changeover means are needed but, as one discharge changeover means can be saved in the present invention, a corresponding weight reduction of the device can be realized. Also, in the conventional art, there is a need to operate the three discharge changeover means so that they can mutually cooperate but, as the cooperation is only between the two discharge changeover means in the present invention, operation needed for the cooperation can be made relatively simple.

It is to be noted that the type and kind of the pressure generating means are not specifically limited. Details in this regard will be described later with respect to embodiments of the present invention.

A second conception of the present invention is a three-axis attitude control propulsion device, in addition to the first conception, wherein one of the two three-way discharge changeover means has three discharge ports, of which orientations of openings are (a) an orientation in a first specific angle, (b) an orientation deviated by 90 degrees counterclockwise from the first specific angle and (c) an orientation deviated by 90 degrees clockwise from the first specific angle. The other of the two three-way discharge changeover means has three discharge ports, of which orientations of openings are (d) an orientation at a second specific angle that is deviated by 180 degrees from the first specific angle, (e) an orientation deviated by 90 degrees clockwise from the second specific angle and (f) an orientation deviated by 90 degrees counterclockwise from the second specific angle. The orientation of (b) above and the orientation of (e) above are parallel to each other.

According to the three-axis attitude control propulsion device based on the present second conception, when a thrust is needed in an upward or downward direction, or in a rightward or leftward direction, the vector of the combustion gas or discharge gas as an operating fluid of the three-axis attitude control propulsion device can be efficiently used. Detailed description in this regard will be made later.

A third conception of the present invention is a three-axis attitude control propulsion device, in addition to the second conception, wherein the orientation of (a) above and the orientation of (d) above are orthogonal to the axis of the pressure generating means and all of the orientations of (a) to (f) above are in one plane orthogonal to the axis of the pressure generating means.

According to the three-axis attitude control propulsion device based on the present third conception, the combustion gas or discharge gas jetted from nozzles can be used only for the three-axis attitude control and there is caused no case where the thrust is generated in an unintended direction.

A fourth conception of the present invention is a three-axis attitude control propulsion device, in addition to the first conception, wherein both of the two three-way discharge changeover means are three-way discharge changeover valves of a valve plug rotation type in which a valve plug is rotated.

According to the three-axis attitude control propulsion device based on the present fourth conception, pressure of the combustion gas or discharge gas acts dispersively in every direction on the entire peripheral portion of the valve plug. Thereby, there is caused no case where the three-way discharge changeover valve is urged to a specific position and an operating torque required for a change of the jetting direction of the gas can be made smaller.

A fifth conception of the present invention is a three-axis attitude control propulsion device, in addition to the fourth conception, wherein the valve plug is constructed of a carbon material.

According to the three-axis attitude control propulsion device based on the present fifth conception, by a self-lubricative property of the carbon material, the above-mentioned operating torque can be made further smaller.

A sixth conception of the present invention is a three-axis attitude control propulsion device, in addition to the fifth conception, wherein the carbon material is graphite.

According to the three-axis attitude control propulsion device based on the present sixth conception, graphite, having a relatively low rate of oxidation reaction in the carbon materials, is employed as the material of the valve plug and the life of the valve plug can be elongated.

A seventh conception of the present invention is a flying object comprising a three-axis attitude control propulsion device based on any one of the first to the sixth conceptions.

The flying object based on the present seventh conception comprises the attitude control device that is able to suppress wasteful consumption of the combustion gas or discharge gas. Thereby, loading quantity of propellant or liquefied gas as a gas generation source can be reduced and the mass corresponding to the reduced quantity can be used for weight reduction of the flying object or for other parts of the flying object. Thus, freedom of design of the flying object can be increased.

BRIEF DESCRIPTION OF THE DRAWINGS

FIGS. 4(*a*) to (*d*) schematically show cross sectional views, together with jetting directions of combustion gas, of a nozzle portion of the three-axis attitude control propulsion device of the first embodiment of FIG. 1.

DESCRIPTION OF THE PREFERRED EMBODIMENTS

First Embodiment

A first embodiment of a three-axis attitude control propulsion device and a flying object comprising the same according to the present invention will be described in detail with reference to the appended drawings.

(Construction)

Figure 1:
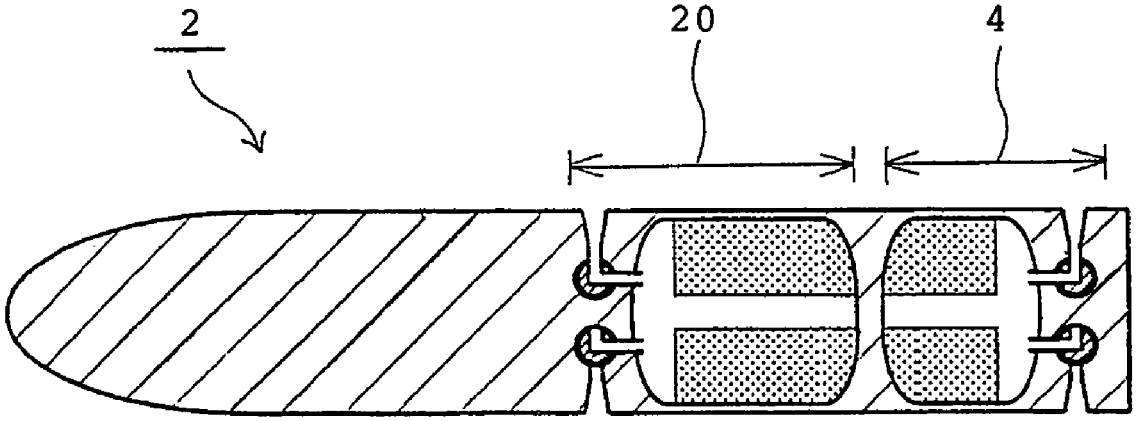
FIG. 1 is a longitudinal axial cross sectional view of an entirety of a flying object comprising a three-axis attitude control propulsion device of a first embodiment according to the present invention.

FIG. 1 is a longitudinal axial cross sectional view of an entirety of a flying object 2 of the present invention, wherein the left hand side in the figure shows a proceeding direction of the flying object 2. The flying object 2 comprises a three-axis attitude control propulsion device 4 and a two-axis translational propulsion device 20. An opening portion of the three-axis attitude control propulsion device 4 is arranged at a rear end of the flying object 2 and an opening portion of the two-axis translational propulsion device 20 is arranged in the vicinity of the center of gravity of the flying object 2.

Figure 2:
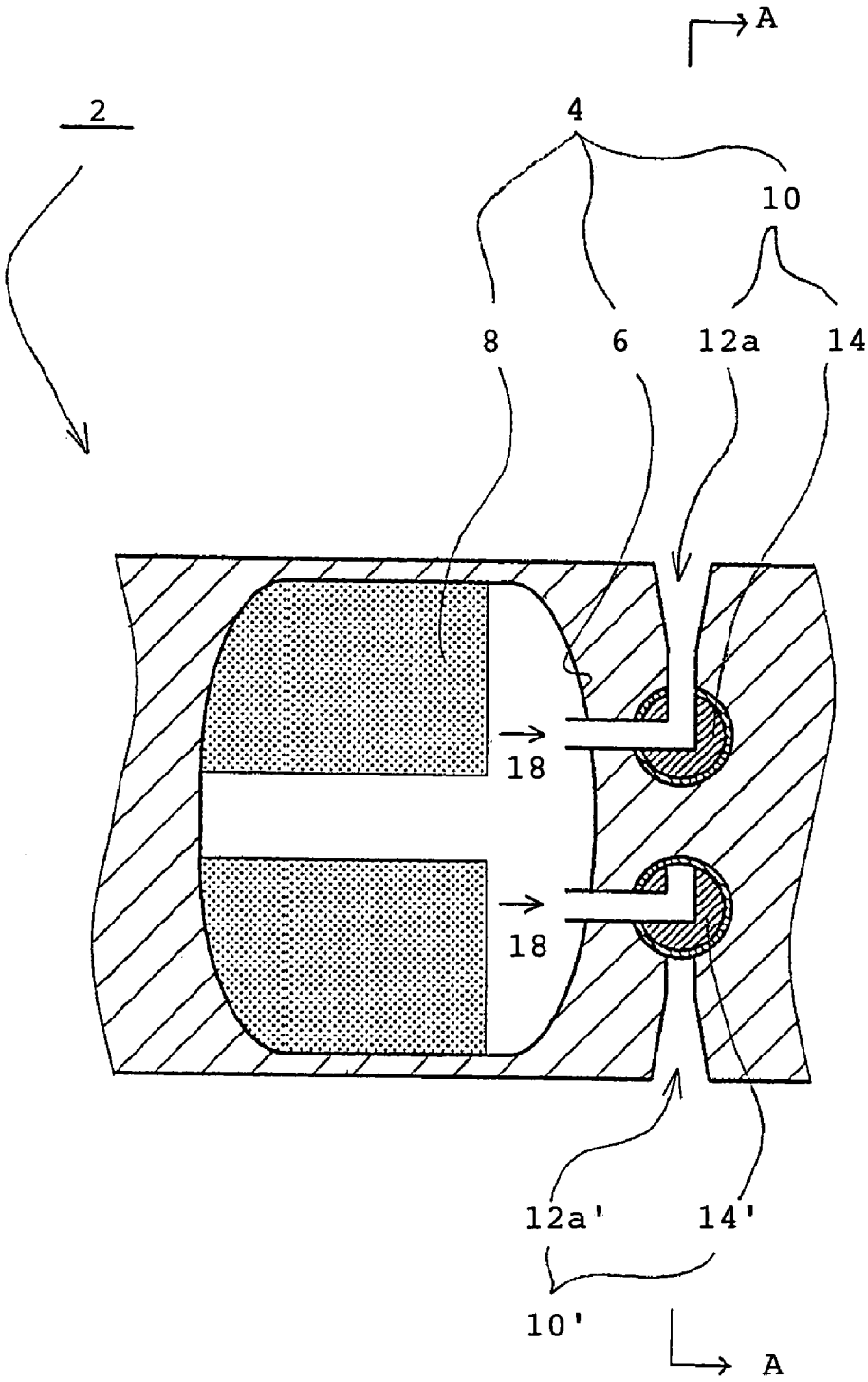
FIG. 2 is an enlarged cross sectional view of a portion of the three-axis attitude control propulsion device of the first embodiment of FIG. 1.
Figure 3:
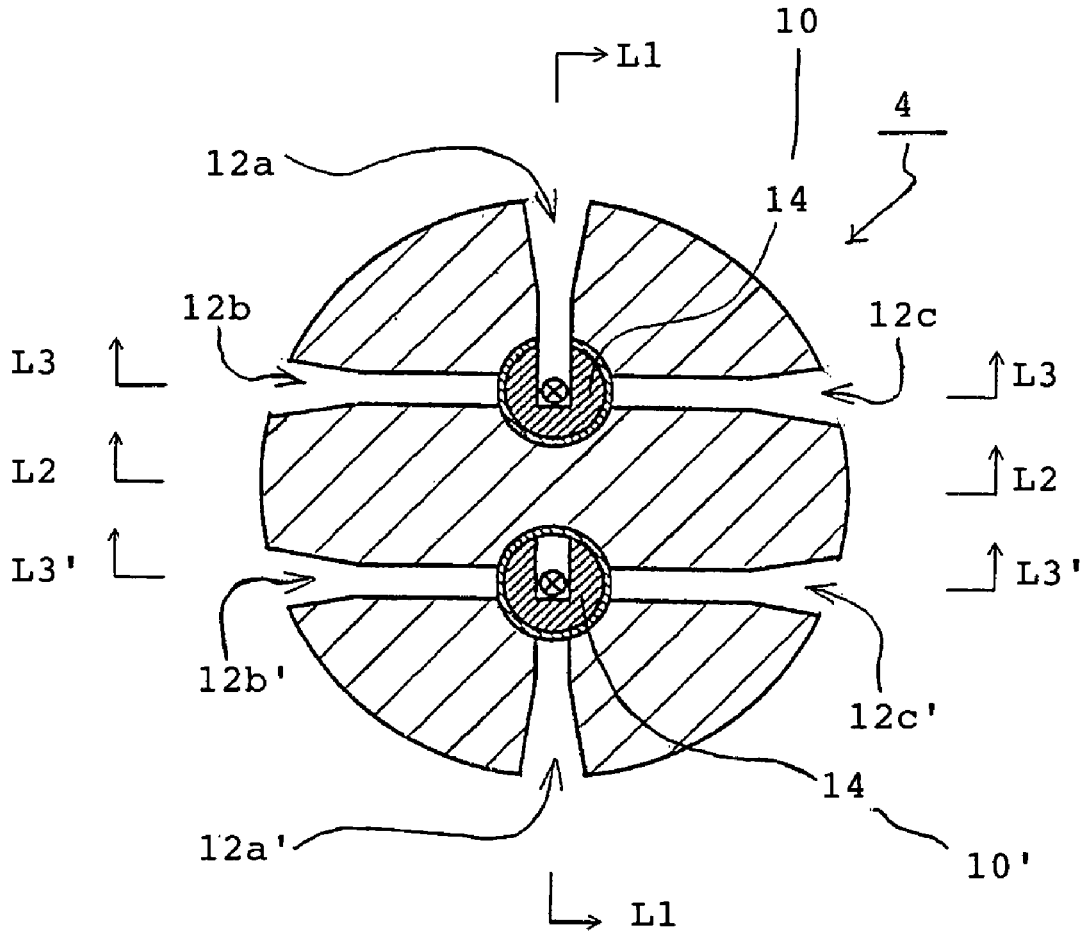
FIG. 3 is a schematic cross sectional view taken on line A—A of FIG. 2, the line A—A being orthogonal to the axis of the three-axis attitude control propulsion device of FIG. 1.

FIG. 2 is an enlarged cross sectional view of the vicinity of the three-axis attitude control propulsion device 4 of the flying object 2. The three-axis attitude control propulsion device 4 comprises a motor case 6, propellant 8, three-way discharge changeover valves 10 and 10', as a three-way discharge changeover means, and six nozzles. FIG. 2, being the longitudinal axial cross sectional view as mentioned above, shows only two nozzles 12*a* and 12*a*'. The six nozzles are shown in FIG. 3 that is a cross sectional view taken on line A—A of FIG. 2 and will be described later. Both of the three-way discharge changeover valves 10 and 10' are connected to one end, or the right hand end in FIG. 1, of the motor case 6. From FIGS. 1 and 2, it is understood that the axis of the flying object 2 and the axis of the three-axis attitude control propulsion device 4 coincide with each other.

It is to be noted that the motor case 6 is a pressure vessel that is a component containing the propellant 8 (a solid) and an igniting device (not shown) as well as having the function of a combustion chamber.

The three-axis attitude control propulsion device 4 is arranged to the rear of the center of gravity of the flying object 2. The rear in this case means a rear relative to the proceeding direction of the flying object 2. This is advantageous as compared with the case where the three-axis attitude control propulsion device 4 is arranged in front of the center of gravity of the flying object 2, because the discharged combustion gas provides no large thermal, chemical or fluid dynamic obstacle to the flying object 2 itself.

FIG. 3 is a schematic cross sectional view taken on line A—A of FIG. 2, as mentioned above.

One suction passage and three discharge passages are provided to connect to each of the three-way discharge changeover valves 10 and 10'. All of the three discharge passages open toward the outside of the flying object 2, so that six nozzles in total are formed. More concretely, (i) a nozzle 12*a*, (ii) a nozzle 12*b* and (iii) a nozzle 12*c* are connected to the one three-way discharge changeover valve 10 and (iv) a nozzle 12*a*', (v) a nozzle 12*b*' and (vi) a nozzle 12*c*' are connected to the other three-way discharge changeover valve 10'. In FIG. 3 showing a circular shape of the transverse cross section of the flying object 2, the nozzles 12*a* and 12*a*' open reversely to each other in the circular radial direction on an imaginary line L1—L1 passing the circular center. Where an imaginary line L2—L2 is a line passing the circular center and orthogonally intersecting the imaginary line L1—L1, there are defined imaginary lines L3—L3 and L3'—L3', respectively, that extend parallel to, and with a predetermined distance apart from, the imaginary line L2—L2. The nozzles 12*b* and 12*c* open on the imaginary line L3—L3 and the nozzles 12*b*' and 12*c*' on the imaginary line L3'—L3'.

The above numbers (i) to (vi) showing the nozzles are used only for convenience of comparison with the claims and drawings and hereafter will be omitted for the purpose of simplicity.

Taking the example of the three-way discharge changeover valve 10 of FIG. 3, where the intersection of the imaginary lines L1—L1 and L3—L3 is a reference and the nozzle 12*a* is seen from an orientation of opening to which the nozzle 12*a* opens, the nozzle 12*b* opens to an orientation deviated by 90 degrees counterclockwise therefrom and the nozzle 12*c* opens to an orientation deviated by 90 degrees clockwise therefrom. Also, taking the example of the three-way discharge changeover valve 10' of FIG. 3, where the intersection of the imaginary lines L1—L1 and L3'—L3' is a reference and the nozzle 12*a*' is seen from an orientation of opening to which the nozzle 12*a*' opens, the nozzle 12*b*' opens to an orientation deviated by 90 degrees clockwise therefrom and the nozzle 12*c*' opens to an orientation deviated by 90 degrees counterclockwise therefrom.

Thus, the three-way discharge changeover valves 10 and 10' have an identical shape to each other and at the same time are positioned in a rotation symmetry of 180 degrees around the intersection of the imaginary lines L1—L1 and L2—L2 as a reference. As a matter of course, this intersection is on the axis of the flying object 2. Also, the six nozzles 12*a*, 12*b*, 12*c*, 12*a*', 12*b*' and 12*c*' are in one plane including this intersection. Thereby, the vector of the combustion gas jetted from at least one of the six nozzles can be effectively used for the three-axis attitude control.

As a variation of the present embodiment, all the above-mentioned six nozzles may be provided so as to open obliquely toward the rear of the flying object 2. Thereby, in any case of a pitch control, roll control, yaw control and neutral state, to be described below, there can be generated a stable thrust for advancing the flying object 2 in the proceeding direction. This thrust can be made use of, for example, for supplementing a velocity decrease of the flying object 2 due to air resistance.

As to the type of the three-way discharge changeover valves 10 and 10', there is no specific limitation and detailed illustration thereof in FIG. 2 or FIG. 3 is omitted. As a preferable type thereof, a three-way discharge changeover valve of a valve plug rotation type can be used in which a valve plug of a holed spherical shape or holed cylindrical shape is rotated. The three-way discharge changeover valves 10 and 10' shown in FIG. 3 are of the valve plug rotation type in which a valve plug 14 of the holed spherical shape is rotated. A circle X mark or arrow rear mark (ⓧ) in FIG. 3 shows an inner flow passage into which the combustion gas flows. The combustion gas flows in in the direction orthogonal to the plane of FIG. 3. In the valve plug 14, there is provided the inner flow passage only in one piece passing therethrough. The valve plug 14 is rotated by a drive means (not shown) to thereby change an orientation of opening of the inner flow passage in an arbitrary direction on the plane of FIG. 3. FIG. 3 shows the state where the three-way discharge changeover valve 10 has only the nozzle 12*a* opened and the three-way discharge changeover valve 10' has all the three nozzles closed. This corresponds to the state of (a) of FIG. 4 to be described later.

It is to be noted that the term "valve plug" means a main part of a valve that is widely known by the experts in this field of industry and detailed description thereof will be omitted.

In any case, if the valve is of the valve plug rotation type, the pressure of the combustion gas can be received dispersively on the surface of the sphere or cylinder, thereby avoiding stress concentration in a specific direction due to the combustion gas. Hence, an operating torque for driving the valve plug can be made smaller.

The above construction comprises only the two three-way discharge changeover valves and the drive means also may be provided in two pieces only.

As a variation of the three-way discharge changeover means, a combination of two two-way discharge changeover valves may be employed in place of one three-way discharge changeover valve.

There is no specific limitation in the material of the valve plug 14. Preferably, a carbon material can be used. This is because the self-lubricative property of the carbon material realizes a high slidability of the valve plug 14 and a high smoothness of the attitude control of the flying object 2. Moreover, even if foreign matter, such as combustion refuse, enters between the valve plug 14 and the portion surrounding the valve plug 14, the carbon material is abraded so as to become complementary to the shape of the foreign matter. Thereby, an effect is obtained such that the foreign matter functions as a bearing and no specific obstruction arises.

Especially, as a more preferable carbon material, graphite can be used. While it is known that graphite is heated red if it is exposed to a high temperature under co-existence of oxygen, it hardly causes a rapid burning and the life of the valve plug 14 can be elongated as compared with the case where a material other than graphite is employed.

(Function)

In the present embodiment, combustion of the propellant 8 is started by an igniting device that is not illustrated. Herein, the description will proceed on the assumption that, until the time when the propellant 8 is entirely consumed, the mass of the combustion gas 18 generated in a unit time is relatively defined as 300 units. If this unit is expressed by SI, it is kg per second. The reason why the number of the assumption is so defined as 300 is because a number divisible by 6 is intended for convenience of the description.

The three-way discharge changeover valves 10 and 10' have the same shape and position between each other symmetrically relative to the axis of the motor case 6, as mentioned above, and the condition of fluidity is also the same between them. Hence, the combustion gas 18 reaches both of the three-way discharge changeover valves 10 and 10' in equal mass of 150 units each.

(Actual Example)

Prior to the description, a definition of X axis and Y axis will be made clear. If seen on FIGS. 1 and 2, the right and left direction on the figure is X direction or, if seen on FIG. 3, the direction orthogonal to the plane of the figure is X direction and the axis of the flying object 2 in the X direction is specifically defined as the X axis. The Y axis is the imaginary line L2—L2 mentioned above.

Next, three axes of the three-axis attitude control will be described. The first axis is the axis in charge of pitch control. The pitch control governs an upward or downward movement of the head of the flying object 2. The second axis is the axis in charge of yaw control. The yaw control governs a rightward or leftward deviation of the head of the flying object 2. The third axis is the axis in charge of a roll control. The roll control governs a spin, or a clockwise or counterclockwise rotation, of the flying object 2 around the X axis as a rotation center. The expressions "upward or downward movement", "rightward or leftward deviation" and "clockwise or counterclockwise rotation" as used above are definitions when the front of the axis of the flying object 2 is seen from the rear of the flying object 2 as a reference.

(Pitch Control)

Here, a case where the head of the flying object 2 is upwardly lifted will be described with reference to FIG. 3 and (a) of FIG. 4. In this case, the three-way discharge changeover valve 10' is fully closed and thus all the combustion gas of 300 units reaches the other three-way discharge changeover valve 10. At this time, the three-way discharge changeover valve 10 is opened toward an orientation of opening of the nozzle 12*a*. The combustion gas 18 of 300 units is jetted upwardly as seen in (a) of FIG. 4 showing a cross section of the rear of the center of gravity of the flying object 2, and a downward thrust is generated. That is, the head of the flying object 2 is directed upwardly around the center of gravity of the flying object 2.

In this case, it is understood that all the combustion gas 18 of 300 units is effectively used for the pitch control. It is to be noted that the combustion gas 18 and the jetting direction thereof are schematically shown by bold black arrows in (a) to (d) of FIG. 4.

(Yaw Control)

A case where the head of the flying object 2 is directed to the left will be described with reference to FIG. 3 and (b) of FIG. 4. In this case, the three-way discharge changeover valve 10 is opened toward the nozzle 12*b* and the other three-way discharge changeover valve 10' is opened toward the nozzle 12*b*'. Then, the combustion gas of 150 units each is jetted leftwardly as seen in (b) of FIG. 4 and a rightward thrust is generated. That is, the head of the flying object 2 is directed leftwardly around the center of gravity of the flying object 2.

In this case, the orientations of openings of the nozzles 12*b* and 12*b*' are parallel to each other so that a simple sum of each vector becomes the composition of vector and it is understood that all the combustion gas 18 of 300 units is effectively used for the yaw control.

(Roll Control)

A case where the flying object 2 is caused to spin, or rolls, clockwise will be described with reference to FIG. 3 and (c) of FIG. 4. In this case, the three-way discharge changeover valve 10 is opened toward the nozzle 12*b* and the other three-way discharge changeover valve 10' is opened toward the nozzle 12*c*'. Then, the combustion gas 18 of 150 units each is jetted leftwardly and rightwardly as seen in (c) of FIG. 4. Thus, the rightward and leftward thrusts are canceled by each other and the flying object 2 rolls clockwise around the X axis as a center.

In this case, the efficiency of using the combustion gas 18 cannot be simply defined because it depends on the position relation between the two three-way discharge changeover valves 10 and 10'. But if a distance between the imaginary line L3—L3 and the imaginary line L3'—L3', as seen in FIG. 3, is made larger, a higher efficiency of the roll control can be obtained, as easily understood by the principle of moments.

(Neutral State)

A neutral state is defined as an operating mode in which none of the above-mentioned three kinds of the attitude control is carried out, that is, the movement of the flying object 2 is left to take its natural course. This state is shown in (d) of FIG. 4. In this case, the three-way discharge changeover valve 10 is opened toward the nozzle 12*a* and the other three-way discharge changeover valve 10' is opened toward the nozzle 12*a'*.

In this case, the combustion gas 18 of 150 units each is jetted upwardly and downwardly as seen in (d) of FIG. 4. Thereby, the downward and upward thrusts are canceled by each other and a state where no thrust is apparently generated, or the neutral state, appears.

Second Embodiment

A second embodiment of a three-axis attitude control propulsion device and a flying object comprising the same according to the present invention will be described in detail with reference to appended drawings.

Figure 5:
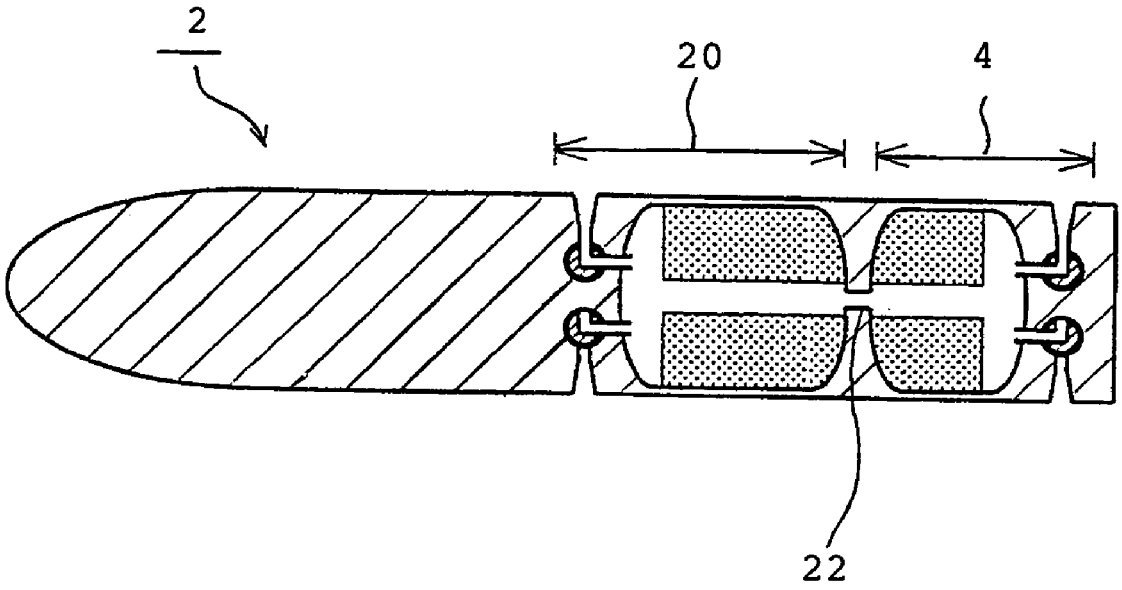
FIG. 5 is a longitudinal axial cross sectional view of an entirety of a flying object comprising a three-axis attitude control propulsion device of a second embodiment according to the present invention.

FIG. 5 is a longitudinal axial cross sectional view of an entirety of a flying object 2 of the second embodiment. The present second embodiment is different from the first embodiment shown in FIG. 1 such that a three-axis attitude control propulsion device 4 and a two-axis translational propulsion device 20, arranged opposite thereto, are not entirely independent of each other but are connected to each other via a communication passage 22.

An advantage of the flying object 2 of the second embodiment remarkably appears in the neutral state. That is, in the three-axis attitude control propulsion device 4 of the first embodiment, the combustion gas of 150 units each is unavoidably jetted in the reverse directions even in the neutral state. If no discharge of the combustion gas 18 is done, the combustion gas 18 loses its place to go and the inner pressure of the motor case 6 will be unusually elevated. In the second embodiment, however, insofar as the two-axis translational control is being done, both of the two three-way discharge changeover valves 10 and 10' of the three-axis attitude control propulsion device 4 can be fully closed. This is because the combustion gas 18 of 300 units can escape to the left-hand side in FIG. 5, or to the two-axis translational propulsion device 20 side, via the communication passage 22 so that it is effectively used as a supplement to the thrust of the two-axis translational propulsion device 20.

(Common Description)

In both of the first and second embodiments, the flying object 2 has no construction for proceeding in the direction of the X axis. This is because the flying object 2 is previously given a velocity in the direction of the X axis by an accelerating means, that is not illustrated, so that it is proceeding in the direction of the X axis by inertia. As the accelerating means, a launcher, detachable type rocket or the like can be named.

There is no specific limitation on the type of the flying object 2 using the three-axis attitude control propulsion device 4 of the present invention. As a flying object in which the attitude control performance is specifically important, an artificial satellite, on-trajectory work station, lunar probe, planet probe, aerospace craft, launching rocket, etc. are especially suitable for the area to which the device of the present invention is applied.

With respect to the present invention, the description has been done with respect to the case where the combustion chamber is provided, that is, the case where the combustion gas 18 generated by combustion of the propellant 8 in the motor case 6 is jetted outside as a thrust source of the attitude control. However, the present invention is not limited thereto, and such a case that an accumulator is provided in place of the combustion chamber, that is, gas accumulated in the accumulator is expanded, or gas physically generated by evaporation of liquid, is jetted outside is included as a matter of course. In this case, differently from the case where the propellant 8 is used, there arises no case where the pressure in the motor case 6 is unusually elevated by the gas that has lost its place to go. For this reason, when the neutral state is selected, all the six nozzles to be used for the three-axis attitude control can be fully closed and wasteful jetting of the gas can be saved.

Both of the combustion chamber and the accumulator, as described herein, are pressure generating means that generate pressure. It is a matter of course that the pressure generating means of the present invention is not limited to the combustion chamber and accumulator. But the pressure generating means by the combustion chamber or accumulator, both being devices widely used in the field, is especially preferable to be used for the present invention from the viewpoint of a reduction of manufacturing cost or a high reliability of operation.

(Comparison Example)

The jetting state of combustion gas for the three-axis attitude control in the technology disclosed by the above-mentioned Japanese Patent 3,291,452 will be described for the purpose of comparison. In (a) to (d) of FIG. 6, the jetting state together with the cross sectional view of three-axis attitude control propulsion device 54 is schematically shown. Supposing that the quantity of combustion gas 68 generated in a unit time is defined as 300 units, the combustion gas 68 is equally separated into three directions in 100 units each, that is, the upward and downward direction along the imaginary line L1—L1, the rightward and leftward direction along the imaginary line L3—L3 and the rightward and leftward direction along the imaginary line L3'—L3'. Then, a selection is made as to whether the combustion gas so equally separated into 100 units each is to be all jetted to one side or to be jetted to both sides in the half quantity each.

In this technology, differently from the present invention in which only the two three-way discharge changeover valves are provided, three pieces of two-way discharge changeover valves are provided. The position relation of the imaginary lines L1—L1, L2—L2, L3—L3 and L3'—L3' is the same. Also, the position relation in which the six nozzles open is the same. Hence, description will be made focusing only on the jetting direction and quantity of the combustion gas 68.

(Pitch Control)

Figure 6:
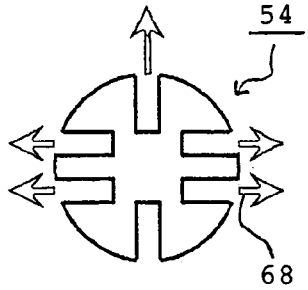
Fig. 6 (Prior Art)
FIGS. 6(*a*) to (*d*) schematically show cross sectional views, together with jetting directions of combustion gas, of a nozzle portion of a three-axis attitude control propulsion device in the prior art.
Figure 6:
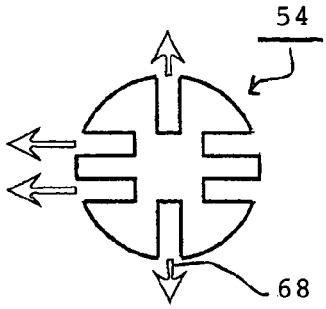
Fig. 6 (Prior Art)
Figure 6:
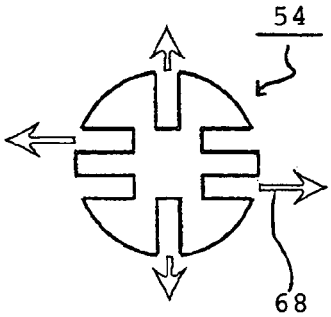
Fig. 6 (Prior Art)
Figure 6:
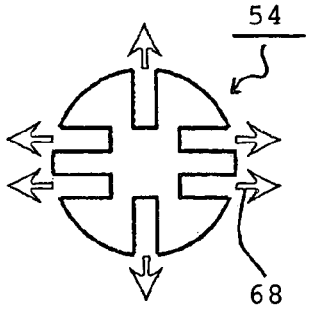
Fig. 6 (Prior Art)

With reference to (a) of FIG. 6, the combustion gas 68 of 100 units is jetted to the upward direction along the imaginary line L1—L1 to thereby obtain an effective thrust, the combustion gas 68 of 50 units each is jetted to the right and left sides along the imaginary line L3—L3 to thereby cancel the thrust and also the combustion gas 68 of 50 units each is jetted to the right and left sides along the imaginary line L3'—L3' to thereby cancel the thrust. That is, the combustion gas 68 of 200 units in total is jetted in the direction of the imaginary lines L3—L3 and L3'—L3' to be wastefully consumed.

(Yaw Control)

With reference to (b) of FIG. 6, the combustion gas 68 of 50 units each is jetted to the upward and downward directions along the imaginary line L1—L1 to thereby cancel the thrust, the combustion gas 68 of 100 units is jetted to the leftward direction along the imaginary line L3—L3 to thereby obtain an effective thrust and also the combustion gas 68 of 100 units is jetted to the leftward direction along the imaginary line L3'—L3' to thereby obtain an effective thrust. That is, the combustion gas 68 of 100 units in total is jetted in the direction of the imaginary line L1—L1 to be wastefully consumed.

(Roll Control)

With reference to (c) of FIG. 6, the combustion gas 68 of 50 units each is jetted to the upward and downward directions along the imaginary line L1—L1 to thereby cancel the thrust, the combustion gas 68 of 100 units is jetted to the left side along the imaginary line L3—L3 and the combustion gas 68 of 100 units is jetted to the right side along the imaginary line L3'—L3'. That is, at least the combustion gas 68 of 100 units in total jetted in the direction of the imaginary line L1—L1 is wastefully consumed.

(Neutral State)

With reference to (d) of FIG. 6, the combustion gas 68 of 50 units each is jetted to all of six orientations of openings of the nozzles along the three imaginary lines L1—L1, L3—L3 and L3'—L3', respectively. By so doing, the apparent thrust is made zero and the neutral state is realized.

According to this technology in the prior art, it is necessary to provide a drive means of three systems in order to drive the nozzles of three pairs for the three-axis attitude control. That is, a surplus of one system must be provided as compared with the present invention and this invites a weight increase and a complexity of the operating system.

According to the present invention, a three-axis attitude control propulsion device that realizes an efficient use of the combustion gas can be provided.

Also, according to the present invention, a three-axis attitude control propulsion device that realizes a smaller operating torque for driving the device can be provided.

Moreover, according to the present invention, a three-axis attitude control propulsion device that realizes a weight reduction and a simple operating system can be provided.

What is claimed is:

1. A three-axis attitude control propulsion device comprising a pressure generating means and two three-way discharge changeover means connected to one end of said pressure generating means, said two three-way discharge changeover means positioned with 180 degrees between each other in a rotational symmetry around a reference of an axis of said pressure generating means, wherein one of said two three-way discharge changeover means has three discharge ports, said three discharge ports having openings having orientations including (a) an orientation at a first specific angle, (b) an orientation deviated by 90 degrees counterclockwise from said first specific angle and (c) an orientation deviated by 90 degrees clockwise from said first specific angle, the other of said two three-way discharge changeover means has three discharge ports, said three discharge ports of the other of said two three-way discharge changeover means having openings having orientations including (d) an orientation at a second specific angle that is deviated by 180 degrees from said first specific angle, (e) an orientation deviated by 90 degrees clockwise from said second specific angle and (f) an orientation deviated by 90 degrees counterclockwise from said second specific angle, and said orientation deviated by 90 degrees counterclockwise from said first specific angle and said orientation deviated by 90 degrees clockwise from said second specific angle are parallel to each other.

2. The three-axis attitude control propulsion device as claimed in claim 1, wherein:

said orientation at said first specific angle and said orientation at said second specific angle that is deviated by 180 degrees from said first specific angle are orthogonal to the axis of said pressure generating means; and all of said orientation at said first specific angle, said orientation deviated by 90 degrees counterclockwise from said first specific angle, said orientation deviated by 90 degrees clockwise from said first specific angle, said orientation at said second specific angle that is deviated by 180 degrees from said first specific angle, said orientation deviated by 90 degrees clockwise from said second specific angle and said orientation deviated by 90 degrees counterclockwise from said second specific angle are in one plane orthogonal to the axis of said pressure generating means.

3. A three-axis attitude control propulsion device as claimed in claim 1, wherein both of said two three-way discharge changeover means are three-way discharge changeover valves of a valve plug rotation type in which a valve plug can be rotated.

4. A three-axis attitude control propulsion device as claimed in claim 3, wherein said valve plug is constructed of a carbon material.

5. A three-axis attitude control propulsion device as claimed in claim 4, wherein said carbon material is graphite.

6. A flying object comprising a three-axis attitude control propulsion device as claimed in claim 1.

7. A flying object comprising a three-axis attitude control propulsion device as claimed in claim 2.

8. A flying object comprising a three-axis attitude control propulsion device as claimed in claim 3.

9. A flying object comprising a three-axis attitude control propulsion device as claimed in claim 4.

10. A flying object comprising a three-axis attitude control propulsion device as claimed in claim 5.

11. A three-axis attitude control device comprising:

a motor case operable to generate pressure; and two three-way discharge changeover valves connected to one end of said motor case, said two three-way discharge valves being positioned with 180 degrees between each other in rotational symmetry around a reference of an axis of said motor case;

wherein one of said two three-way discharge changeover valves has three discharge ports, said three discharge ports having openings having orientations including (a) an orientation at a first specific angle, (b) an orientation deviated by 90 degrees counterclockwise from said first specific angle and (c) an orientation deviated by 90 degrees clockwise from said first specific angle;

wherein the other of said two three-way discharge changeover valves has three discharge ports, said three discharge ports of the other of said two three-way discharge changeover valves having openings having orientations including (d) an orientation at a second specific angle that is deviated by 180 degrees from said first specific angle, (e) an orientation deviated by 90 degrees clockwise from said second specific angle and (f) an orientation deviated by 90 degrees counterclockwise from said second specific angle; and wherein said orientation deviated by 90 degrees counterclockwise from said first specific angle and said orientation deviated by 90 degrees clockwise from said second specific angle are parallel to each other.

12. A three-axis attitude control device as claimed in claim 11, wherein both of said two three-way discharge changeover valves are of a valve plug rotation type in which a valve plug can be rotated.

13. A three-axis attitude control propulsion device as claimed in claim 12, wherein said valve plug is constructed of a carbon material.

14. A three-axis attitude control device as claimed in claim 13, wherein said carbon material is graphite.

15. A flying object comprising a three-axis attitude control device as claimed in claim 11.

16. The three-axis attitude control device as claimed in claim 11, wherein:

said orientation at said first specific angle and said orientation at said second specific angle that is deviated by 180 degrees from said first specific angle are orthogonal to the axis of said motor case; and all of said orientation at said first specific angle, said orientation deviated by 90 degrees counterclockwise from said first specific angle, said orientation deviated by 90 degrees clockwise from said first specific angle, said orientation at said second specific angle that is deviated by 180 degrees from said first specific angle, said orientation deviated by 90 degrees clockwise from said second specific angle and said orientation deviated by 90 degrees counterclockwise from said second specific angle are in one plane orthogonal to the axis of said motor case.

* * * * *